United States Patent [19]

Betti

[11] 4,285,612

[45] Aug. 25, 1981

[54] PROTECTIVE SHOULDER STRUCTURE FOR ROADWAY JOINTS

[75] Inventor: Pier L. Betti, Sao Paulo, Brazil

[73] Assignee: Dinamyk Pesquisa E. Desenvolvimento Tecnologico S/C Ltda. Tecnologia de Solucoes, Sao Paulo, Brazil

[21] Appl. No.: 47,117

[22] Filed: Jun. 11, 1979

[51] Int. Cl.[3] ..... E01C 11/04

[52] U.S. Cl. ..... 404/68; 52/396; 404/75; 14/16.5

[58] Field of Search ..... 404/68, 69, 72, 74, 404/75, 87, 47, 49; 52/396; 14/16.5

[56] References Cited

U.S. PATENT DOCUMENTS

| | | | |
|---|---|---|---|
| 1,320,222 | 10/1919 | Gage | 404/87 X |
| 1,383,459 | 7/1921 | Ficklen | 404/74 |
| 1,769,990 | 7/1930 | Fischer | 404/68 |
| 1,891,897 | 12/1932 | Fischer | 404/87 |
| 2,539,875 | 1/1951 | Van London | 404/74 |
| 3,829,228 | 8/1974 | Miyazaki | 404/68 |
| 4,098,047 | 7/1978 | Weber | 404/68 X |

*Primary Examiner*—Nile C. Byers, Jr.

*Attorney, Agent, or Firm*—Toren, McGeady and Stanger

[57] ABSTRACT

A roadway joint wherein a gap between two generally parallel concrete walls of the roadway structure is bridged by a joint assembly having resilient characteristics is reinforced by a protective shoulder structure which will avoid abrasion, wear and destruction due to traffic of the concrete shoulders of the walls forming the joint by forming the adjacent edges of the shoulders from silica-epoxy mortar which is cured into suitable sockets formed in the concrete shoulders of the adjacent walls.

1 Claim, 5 Drawing Figures

PROTECTIVE SHOULDER STRUCTURE FOR ROADWAY JOINTS

BACKGROUND OF THE INVENTION

The present invention relates generally to roadway construction and more particularly to techniques for avoiding crumbling or deterioration of the structural edges of a roadway joint assembly. More specifically, the invention is especially adaptable for use in roadway structures wherein joint assemblies having resilient characteristics are utilized.

As is generally known, one of the most troublesome problems related to concrete structures upon which vehicular traffic must pass is the wear and deterioration that occurs to the edges of pavement or similar material, particularly at joints which must be formed between two adjacent concrete walls or slabs which form the roadway structure.

In order to overcome problems of this type, many attempts have been made to provide protective devices for different parts of the roadway. Such protective devices may involve, for example, angular iron members, steel ribs and the like.

However, all of the metallic protectors which are in use today give rise to great inconvenience for several reasons. First of all, it is relatively difficult to achieve a good metal-to-concrete connection primarily due to the rather difficult conditions created by different thermal expansion coefficients. As a result, the attachment of such metallic protectors will generally be accomplished by the utilization of anchorage devices which must be imbedded into the concrete and which must be welded to metallic protective members.

As will be evident, significant stresses will arise in roadway structures whereby different parts of the roadway will move relative to other parts because of the different stresses and because of varying thermal characteristics. The stresses which occur because of traffic load will usually be concentrated at the metallic anchorage devices thereby causing them to become loosened after a relatively short period of time. This and other problems which arise in structures of this type will require frequent road maintenance procedures.

The present invention is directed toward providing an improved protective system for roadbed joints of the type described above. The advantage of the present invention resides in the fact that continuous structural protection may be built-in at the edge of the concrete slab of the roadway without requiring utilization of metallic anchorages. Protection of the type afforded by the present invention enables high performance anti-abrasive edge structures to be provided which may be totally bonded to the concrete of the roadway slab and which will present a thermal expansion coefficient equivalent to the thermal expansion coefficient of the concrete itself.

Of particular importance is the fact that the arrangement of the present invention permits the utilization of flexible joints, especially a joint of a particular type which gives rise to significant advantage.

The significant advantages of the invention involve the fact that the roadway joints utilizing the invention may be built at any time after the pouring of the concrete without depending upon accurate positioning of metallic protectors or anchors. The joint may be totally or partially repaired without destroying the nearby concrete and it will provide a continuous non-skid surface. The arrangement of the invention provides a joint which is totally capable of resisting oxidation, water penetration and which is also resistant to most solvents and chemicals. The invention permits the equal distribution of load of traffic over the joint system while avoiding stress concentration.

SUMMARY OF THE INVENTION

Briefly, the present invention may be described as an improvement in a roadway structure formed of concrete slabs interconnected by a joint formed between a pair of opposed walls of said slabs, said walls defining therebetween a gap which is bridged by said joint, the improvement of the invention particularly comprising shoulder portions defining at least the upper adjacent edges of said opposed walls of said slabs, said shoulder portions consisting essentially of cured silica-epoxy mortar built into the walls of the slabs by compacting the silica-epoxy mortar into previously prepared sockets formed in the walls to provide structurally bonded reinforcement at the shoulder portion. A resilient joint interposed between the opposed walls may extend in adhesive bonding engagement at least along the portions of the walls defined by the shoulder portions of the present invention.

In the preparation of the joint of the invention, at the time that concrete is poured, a socket may be provided at the edges of the slabs which form the walls to be connected by the joint, the socket being formed by sawing the already existing concrete structure. The socket may then receive the silica-epoxy mortar which is compacted by means of a compacter device to the level of the pavement. Thereafter, the silica-epoxy mortar may be allowed to harden which will occur in a few hours thereby enabling the structure to be ready for use.

If necessary, the socket which is formed in the concrete shoulders of the slabs may be previously primed with an appropriate adhesive to improve the bonding qualities between the mortar and the concrete.

The device of the present invention is particularly suitable for use with a sealing system wherein a resilient joint is formed between the opposed walls of the slabs. The joint with which the present invention is used may particularly comprise a sealing element consisting essentially of resilient material and formed to define cavity means internally thereof. An adhesive material is applied between the sealing element and each of the opposed walls of the slabs in order to effect an adhesive bond therebetween, the adhesive material being capable of setting after application thereof in order to effect the adhesive bond. A filler material is then introduced into the cavity means of the sealing element under pressure and the filler material is rendered rigid after introduction into the cavity means. The sealing element is capable of undergoing flexure as the result of introduction into the cavity means of the pressurized filler material thereby to maintain the adhesive bond pressed between the sealing element and the opposed walls during setting of the adhesive material. The filler material and the adhesive material are selected such that the adhesive material sets to form the adhesive bond in the joint prior to hardening of the filler material within the cavity means.

By combining a joint system of this type with the silicon-epoxy mortar shoulder portions of the invention, a particularly long lasting, durable and effective joint system may be formed between slabs of a roadway structure.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
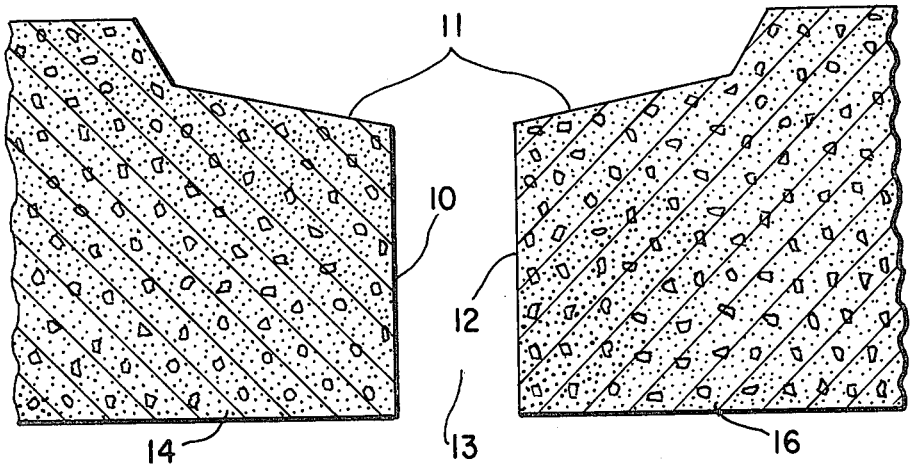
FIGS. 1-4 are, respectively, cross sectional views showing the structure of the present invention in different stages of formation thereof.
Figure 2:
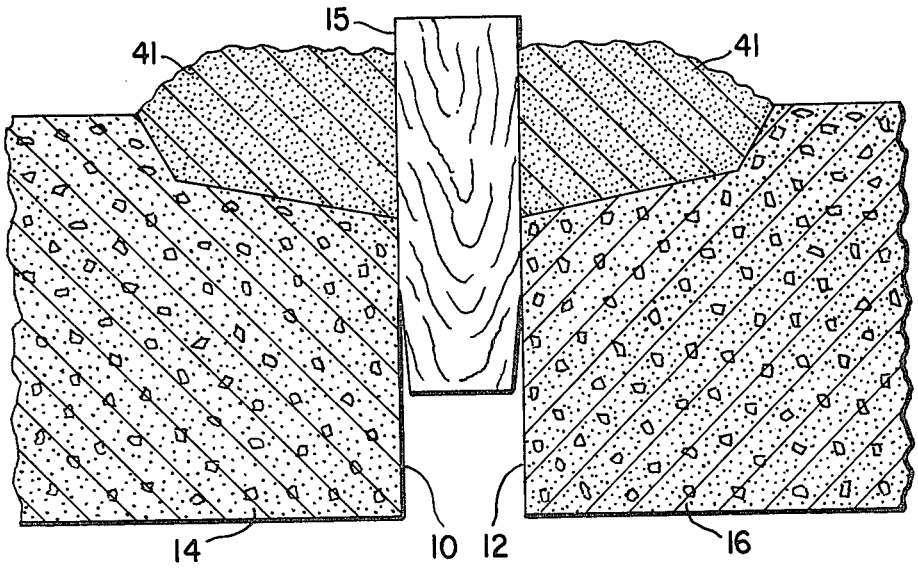

Referring first to FIG. 1, there is shown an example of a site where a seal or joinder must be formed between a pair of opposed walls. In FIG. 1, there are shown walls 10 and 12 which may represent the terminations of two sections 14 and 16 of a pair of slabs of a roadway, which slabs are to be joined together. Since roadways of the type to which the present invention relates are not normally formed in continuous, unbroken concrete sections, gaps such as that between the walls 10 and 12 will exist between sections of the roadway. Accordingly, it becomes necessary to seal or otherwise join together the walls 10 and 12 so that there will be formed a unitary structure which will, nevertheless, be capable of absorbing relative movements between the walls 10 and 12 which may occur during stressing or loading of the roadway.

Figure 5:
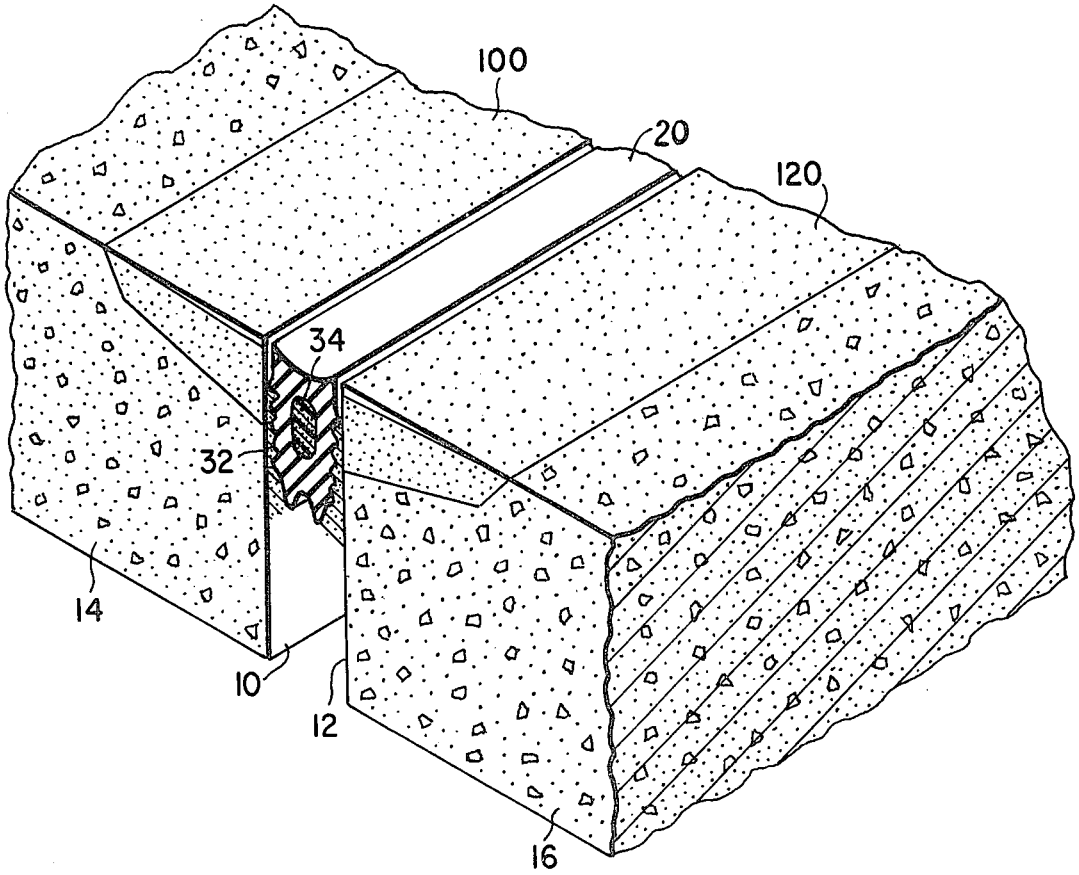
FIG. 5 is a perspective view showing a finished joint system utilizing the shoulder structure of the invention and a resilient joint system.

A seal of the type contemplated for use with the present invention is shown in FIG. 5 wherein the structure in accordance with the invention is depicted in its finished form. As will be noted from FIG. 5, a sealing element 20 which essentially comprises a longitudinal member of resilient material is interposed between the walls 10 and 12. The present invention is particularly concerned with the shoulder portions 100 and 120 which are formed adjacent the resilient joint formed by the sealing member 20.

As will be noted from FIG. 5, the basic slabs 14, 16 which form the roadway are made from concrete. If the portions occupied by the shoulders 100 and 120 are permitted to be composed of concrete material, then severe problems could develop because of chipping, breakage or wear of the portions adjacent the resilient joint. Since the slabs forming the roadway will be particularly susceptible to damage at these areas, it is important that these areas be reinforced so that the joint system which is formed will be long-lasting and durable.

By the present invention, the portions of the concrete slabs which occupy the edges of the slabs adjacent the resilient joint, are removed by sawing or by some similar procedure, thereby to form sockets 11 at the upper edge portions of the walls 10 and 12 of the concrete slabs 14 and 16. After the sockets 11 have been formed, a sizing board 15 having a width equivalent to a gap 13 existing between the walls 10 and 12 is placed in position between the walls 10 and 12, the sizing board 15 extending upwardly beyond the upper terminations of the slabs 14 and 16. Subsequently, silica-epoxy mortar material 41 is introduced into each of the sockets 11 on either side of the sizing board 15.

Figure 3:
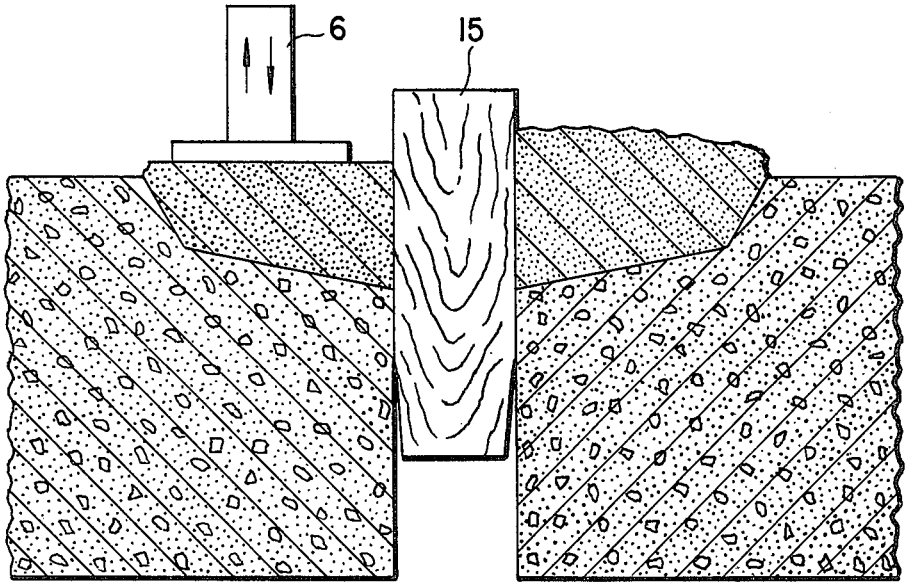
Figure 4:
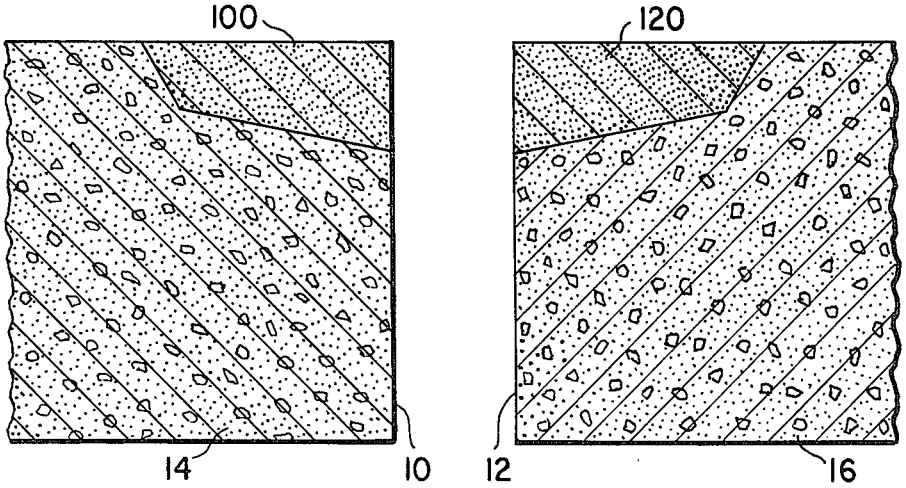

After the mortar 41 has been placed in position, a compacter 6 is applied to the mortar material 41, as best seen in FIG. 3. The mortar material 41 is compacted down to the upper level of the slabs 14 and 16 in order to form the shoulder portions 100, 120, as seen in FIG. 4, wherein the finished shoulder portions are depicted prior to introduction of the sealing joint. The sizing board 15 may then be removed and a smooth gap will exist between the walls 10 and 12 within which a resilient sealing member may be provided. Furthermore, the shoulder portions 100, 120 will be smooth and continuous with the upper surface of the slabs 14, 16.

After the silica-epoxy mortar material 41 has been compacted and formed into the proper shape, it may be permitted to cure whereby the protective shoulders 100, 120 will be formed. Of course, an appropriate curing time should be permitted to elapse whereupon the seal between the walls 10 and 12 may be formed.

As best seen in FIG. 5, the seal of the present invention will comprise the sealing element 20 which has a longitudinal cavity formed therein within which filler material 34 may be introduced under pressure. Prior to introduction into the sealing element 20 of the filler material 34, an adhesive material 32 is applied between the sealing element 20 and the walls 10 and 12. Subsequently, the filler material 34 is introduced under pressure and the sealing element 20 is caused to flex in order to adapt its shape to the sides or walls 10 and 12 of a joint which is to be formed. It is of particular advantage if the adhesive material 32 which is selected is of the type which will set before elapse of a sufficient period of time to allow the filler material 34 to become hardened or rigid. Thus, during the period of time that the adhesive material 32 is setting, the filler material 34 remains in a relatively liquid state and under pressure within the sealing element 20 thereby maintaining the adhesive 32 under pressure until it sets.

With the finished joint arranged as shown in FIG. 5, the resilient member 20 will provide a sturdy connection between the walls 10 and 12 while allowing the walls to move relative to each other to a given degree in order thereby to permit displacements which may occur due to thermal expansion or the like without injuring or rupturing the joint. The shoulder portions 100 and 120 since they are formed of a silica-epoxy mortar which has undergone curing, will provide very sturdy and durable shoulder portions adjacent the sealing element 20 thereby greatly reducing the susceptibility to damage of the joint system and the necessity for frequent maintenance procedures.

Of course, it should be understood that, prior to filling of the sockets 11 with the silica-epoxy mortar material 41, the sockets may be previously primed with a proper adhesive to improve bonding between the mortar and the concrete.

As will be seen from the foregoing, the improvement of the present invention will provide for the edges of a concrete structure a longitudinal and transverse reinforcement which will consist of a protective shoulder which is structurally bonded to the concrete by compacting of the silica-epoxy mortar into the preformed sockets thereby achieving, after curing, a resistent edge which distributes the load of traffic and which protects the concrete edges from wear which may be caused by such traffic.

While a specific embodiment of the invention has been shown and described in detail to illustrate the application of the inventive principles, it will be understood that the invention may be embodied otherwise without departing from such principles.

What is claimed is:

1. In a roadway structure formed of concrete slabs interconnected by a joint formed between a pair of opposed walls of said slabs, said walls defining therebetween a gap which is bridged by said joint, the improvement comprising shoulder portions defining at least the upper adjacent edges of said opposed walls of said slabs, said shoulder portions consisting essentially of cured silica-epoxy mortar built into said walls by compacting said silica-epoxy mortar into previously prepared sockets formed in said walls to provide structurally bonded reinforcement at such shoulder portions, and resilient joint means interposed between said opposed walls and extending in adhesive bonding engagement at least along said silica-epoxy mortar shoulder portions, said resilient joint means comprising a sealing element consisting essentially of resilient material and formed to define cavity means internally thereof, and adhesive material applied between said sealing element and each of said opposed walls to effect an adhesive bond therebetween, said adhesive material being capable of setting after application thereof to effect said adhesive bond, a filler material introduced into said cavity means under pressure and rendered rigid after introduction into said cavity means, said sealing element being capable of undergoing flexure as a result of introduction into said cavity means of said pressurized filler material to maintain said adhesive pressed between said sealing element and said opposed walls during setting of said adhesive material, said filler material and said adhesive material being selected such that said adhesive material sets to form said adhesive bond in said joint prior to hardening of said filler material within said cavity means.

* * * * *